US007295127B2

(12) United States Patent
Haynes

(10) Patent No.: US 7,295,127 B2
(45) **Date of Patent: *Nov. 13, 2007**

(54) NATIONAL SECURITY WARNING SYSTEM INTEGRATED WITH BUILDING FIRE ALARM NOTIFICATION SYSTEM

(75) Inventor: John R. Haynes, Groton, MA (US)

(73) Assignee: SimplexGrinnell LP, Westminster, MA (US)

( * ) Notice: Subject to any disclaimer, the term of this patent is extended or adjusted under 35 U.S.C. 154(b) by 24 days.

This patent is subject to a terminal disclaimer.

(21) Appl. No.: 10/720,810

(22) Filed: Nov. 24, 2003

(65) Prior Publication Data

US 2005/0057342 A1 Mar. 17, 2005

Related U.S. Application Data

(60) Provisional application No. 60/502,337, filed on Sep. 12, 2003.

(51) Int. Cl.
*G08B 17/10* (2006.01)

(52) U.S. Cl. ..... 340/628; 340/539.14; 340/686.1; 340/825.36; 340/506; 379/43; 379/33

(58) Field of Classification Search ..... 340/628, 340/500, 506, 539.1, 539.26, 539.28, 825.36, 340/331, 438, 686.1, 540, 539.14; 379/43, 379/37, 39, 48, 49, 33
See application file for complete search history.

(56) References Cited

U.S. PATENT DOCUMENTS

| | | | | |
|---|---|---|---|---|
| 4,417,217 | A | 11/1983 | Sugiyama | |
| 4,641,127 | A | 2/1987 | Hogan et al. | |
| 5,278,539 | A * | 1/1994 | Lauterbach et al. | 340/539.18 |
| 5,444,433 | A * | 8/1995 | Gropper | 340/601 |
| 5,949,332 | A | 9/1999 | Kim | |
| 6,121,885 | A * | 9/2000 | Masone et al. | 340/628 |
| 6,295,001 | B1 | 9/2001 | Barber | 340/601 |
| 6,380,860 | B1 | 4/2002 | Goetz | |
| 6,426,697 | B1 * | 7/2002 | Capowski et al. | 340/506 |
| 6,462,665 | B1 * | 10/2002 | Tarlton et al. | 340/601 |
| 6,633,240 | B1 * | 10/2003 | Sweatt | 340/995.1 |
| 6,696,942 | B2 * | 2/2004 | Sweatt | 340/539.1 |
| 6,710,715 | B2 * | 3/2004 | Deeds | 340/601 |
| 2004/0085218 | A1 | 5/2004 | Pecora | |

FOREIGN PATENT DOCUMENTS

| | | |
|---|---|---|
| EP | 0 037 237 A2 | 10/1981 |
| EP | 0 269 747 B1 | 6/1988 |
| EP | 0 811 959 B1 | 12/1997 |
| EP | 0811959 | 12/1997 |
| EP | 0 834 846 B1 | 4/1998 |

OTHER PUBLICATIONS

Tony Pugh, "National warning systems in works," published in the Boston Globe on Feb. 25, 2002 in Boston, Massachusetts.

(Continued)

*Primary Examiner*—Benjamin C. Lee
*Assistant Examiner*—Daniel Previl

(57) ABSTRACT

A fire alarm system includes a fire alarm notification appliance, and a warning detector which detects a warning alert from an external source. The fire alarm notification appliance provides notification of the warning alert in response to detection of the warning alert.

57 Claims, 3 Drawing Sheets

OTHER PUBLICATIONS

National Public Radio, South Dakota radio reporter, Curt Nickisch reporting on a system designed for emergency notification, Feb. 15, 2002.

"EAS Safety 1st", 2004 TFT Inc.; http:/www.tftinc.com/products/datasheets/eas911i.pdf.

* cited by examiner

NATIONAL SECURITY WARNING SYSTEM INTEGRATED WITH BUILDING FIRE ALARM NOTIFICATION SYSTEM

RELATED APPLICATION(S)

This application claims the benefit of U.S. Provisional Application No. 60/502,337, filed Sep. 12, 2003. The entire teachings of the above application(s) are incorporated herein by reference.

BACKGROUND

Recently, U.S. Homeland Security Director Tom Ridge announced a soon-to-be-deployed national terrorism alert system whose goal is to provide a "unified warning apparatus that is universally understood. It has been proposed that the alarms would be broadcast over National Oceanic and Atmospheric Administration (NOAA) radios and would signal alert conditions—in descending order of urgency—of: critical, serious, alert and ready.

According to published information, the system would be used to alert state and local police and emergency personnel. According a report broadcast by National Public Radio on Feb. 15, 2002, the state of South Dakota has purchased 5,000 weather radios and is distributing them to universities, hospitals, law enforcement agencies and day care centers to provide a means of public emergency notification.

One advantage of the NOAA weather radios is that they turn themselves on when an alert is broadcast, increasing the likelihood that they will be noticed.

SUMMARY OF THE INVENTION

The present invention extends the concept of a national warning alert proposal by incorporating a NOAA weather radio receiver into, or interfacing a NOAA weather radio receiver with, a building fire alarm system. Because code-compliant fire alarm panels are already equipped with voice and/or audio and visual notification appliances, they provide a ready means with which to notify building occupants of a national alert.

In accordance with the present invention, a fire alarm system includes a fire alarm notification appliance, and a warning detector which detects a warning alert from an external source. The fire alarm notification appliance provides notification of the warning alert in response to detection of the warning alert or a change in the status of the warning alert.

The external source may be, but is not limited to, a government agency, such as the U.S. National Oceanic and Atmospheric Administration (NOAA). The warning detector may be a radio receiver equipped to receive the warning alert, such as a NOAA weather radio receiver, and may be, for. example, integrated with a system controller or fire alarm control panel. Alternatively, the warning detector may comprise a component that interfaces to a NOAA weather radio receiver, for example, via relay contacts that open (or close) upon detection of a warning alert, or via a serial or some other data interface.

In alternate embodiments, the warning detector may receive warning alerts via means other than radio; for example, via the Internet, via telephone or via cellular phone. Other means of communication can also be used.

In one embodiment, a fire alarm notification appliance provides notification of the detected warning alert by transmitting a voice message. Alternatively, a notification appliance could provide notification by transmitting a predefined audio pattern, or by flashing a predefined strobe pattern. Different notifications, such as different voiced messages, or different horn patterns, can be used for different warning alerts.

Delay and verification modules, which may comprise hardware or software or both, and which may be integrated with the system controller, can provide respectively a delay before transmission of the notification warning, and means for allowing confirmation of the validity of the warning alert before transmission of the notification, for example by authorized personnel.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

The present invention extends the concept of a national warning alert proposal by incorporating a NOAA weather radio receiver into, or interfacing a NOAA weather radio receiver with, a building fire alarm system. Because code-compliant fire alarm panels are already equipped with voice and/or audio and visual notification appliances, they provide a ready means with which to notify building occupants of a national alert. Code-compliant fire alarm panels are also equipped with battery backup power. In the event that normal AC power is lost, the panel can still transmit the notification.

For example, a national alert signal transmitted to a NOAA weather radio that is interfaced to a fire alarm system causes the fire panel, which has been pre-programmed to respond to the alert, to transmit a voice message to the occupants of the building. Such a message might be: "Attention! Attention! A security alert has been received from the National Homeland Security Department." Then, depending upon the level of the alert condition, the panel broadcasts an appropriate message. For example:

"A critical security alert has been received. Immediately implement response plan 1."

OR

"A ready security alert has been received. No action is required at this time. Stay tuned for further information."

In non-voice fire alarm systems, the notification horns and strobes could be programmed to signal building occupants using pre-defined patterns, e.g., temporal code. Training and drills will be needed to ensure that occupants will understand the various security alerts.

Such an alert system could be retrofit to most existing fire alarm systems with relatively little expense, enabling the government to notify a vast number of citizens quickly in a national emergency. The system could be put into place quickly and with a relatively small investment.

Implementation can be accomplished in several ways, including but not limited to the following:

1) The NOAA radio can be directly incorporated as a module within a fire panel; or
2) The NOAA radio can be interfaced to the fire panel via relay contacts; or
3) The NOAA radio can be interfaced to the fire panel through a serial interface device that translates the alert signal into a recognizable command to the fire alarm panel.

Figure 1:
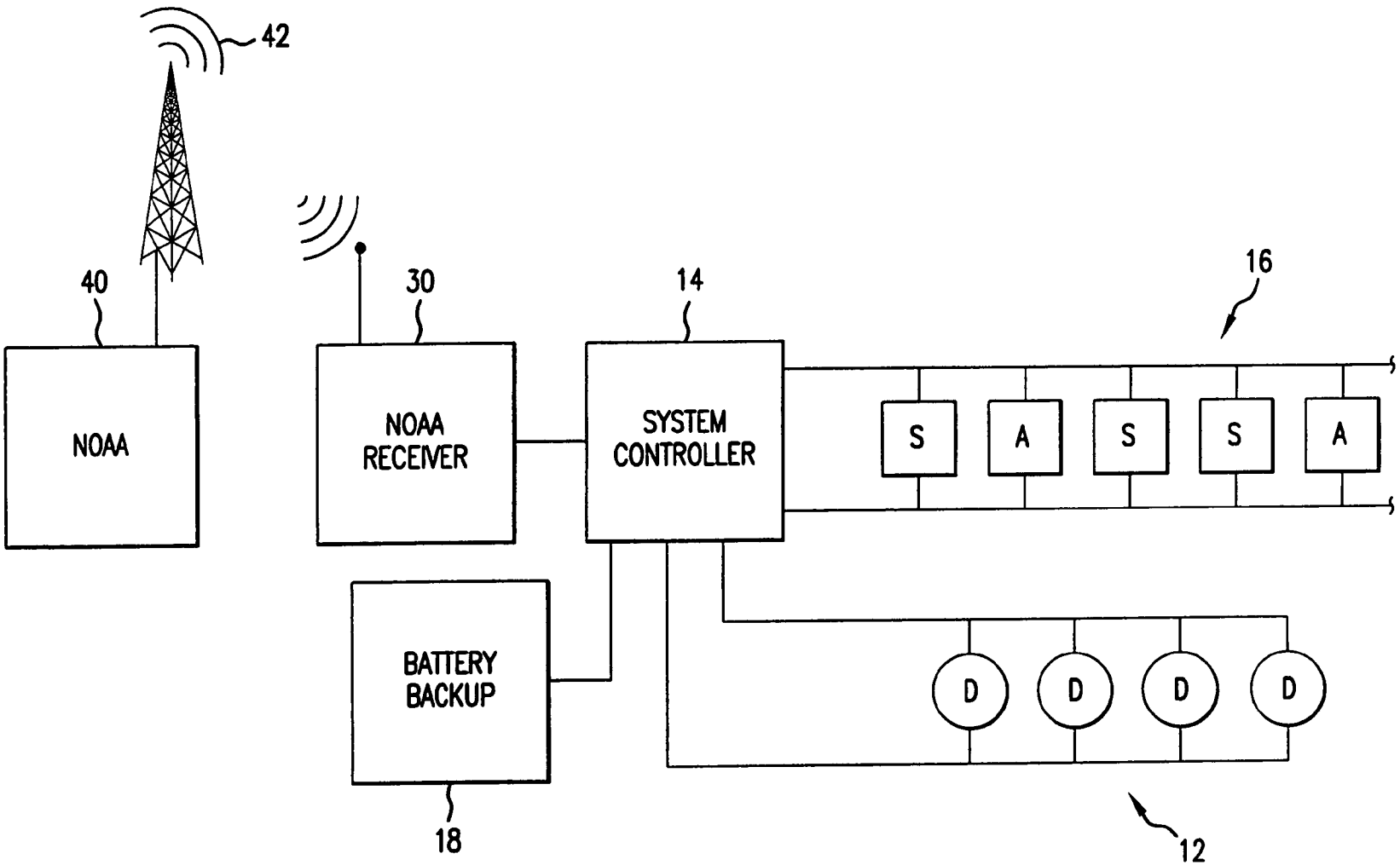
FIG. 1 is a schematic diagram illustrating-an alarm system embodying the present invention.

FIG. 1 is a schematic diagram illustrating an alarm system embodying the present invention. The system may include one or more detector networks 12 having individual fire or smoke detectors D which are monitored by a system controller/fire alarm panel 14. When a fire or smoke alarm condition is sensed, the fire alarm panel 14 signals the alarm through at least one network 16 of alarm indicators, also called notification appliances. The notification appliances may include any variety of audible alarms A and light strobe alarms S.

An external NOAA receiver 30 is shown receiving a warning alert signal 42 broadcast from an NOAA transmitting station 40. A circuit performing the NOAA receiver function could also be incorporated directly into the system controller 14.

The system controller 14, which may be, for example, a fire alarm panel, is programmed to respond to the NOAA warning alert signal 42 with a series of pre-defined actions. For example, if an alert is received, a general announcement is played; if the alert level is "critical," then some particular message designated with that alert level is played.

Code-compliant fire alarm panels are typically equipped with a battery backup system 18. In the event that normal AC power is lost, the fire alarm panel 14 can still transmit a notification.

The idea can be extended to include transmission of warning signals from other state or local government agencies, e.g., the old Emergency Broadcast System or the newer Emergency Alert System. Media other than the NOAA weather radio can also transmit such signals. For example, an alert signal can be transmitted via the Internet, telephone, cellular phone, or other media to a fire panel equipped to receive such signals.

Figure 2:
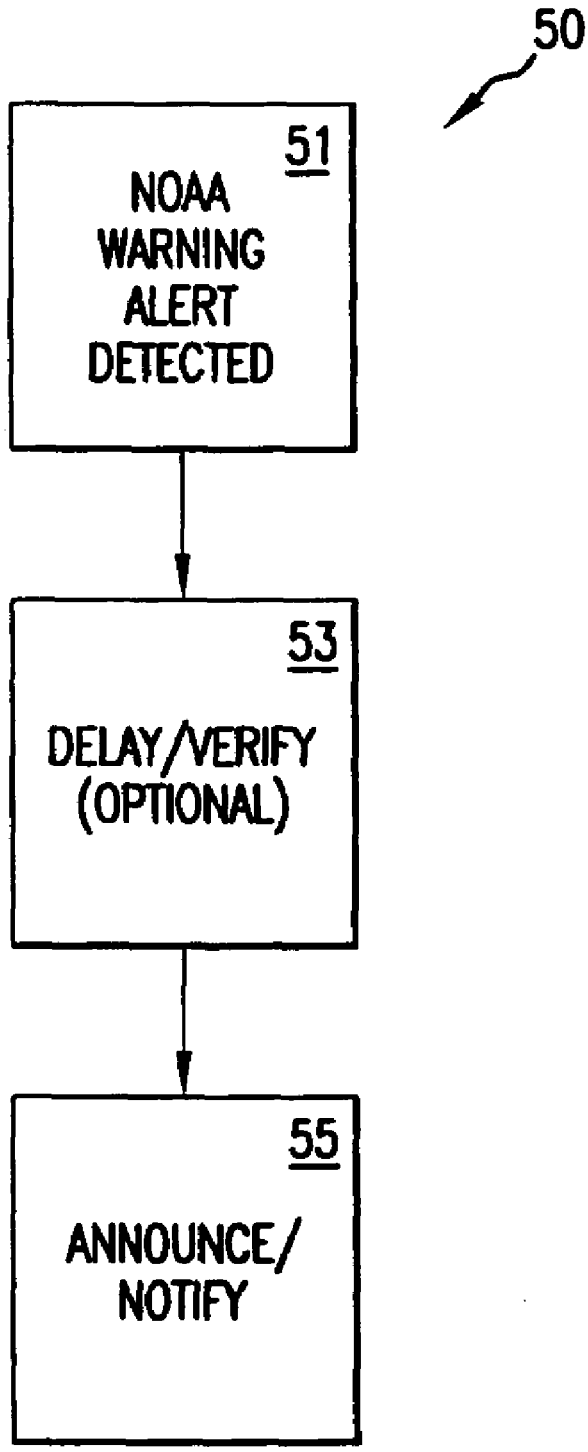
FIG. 2 is a flowchart illustrating the steps implemented by a particular embodiment of the present invention.

FIG. 2 is a flowchart 50 illustrating the steps implemented by a particular embodiment of the present invention. At step 51, a warning alert from an external source such as the U.S. NOAA, or some other government agency (although the invention is not limited only to government sources) is detected.

To prevent false alarms or panic situations, an embodiment of the present invention can, at step 53, incorporate a fixed or variable delay to the retransmission of the alert signal within the building for some pre-determined time period to give local building authorities time to confirm the validity of the received warning signal.

Finally, at step 55, the system announces, through voice or non-voice means, the warning alert.

Figure 3:
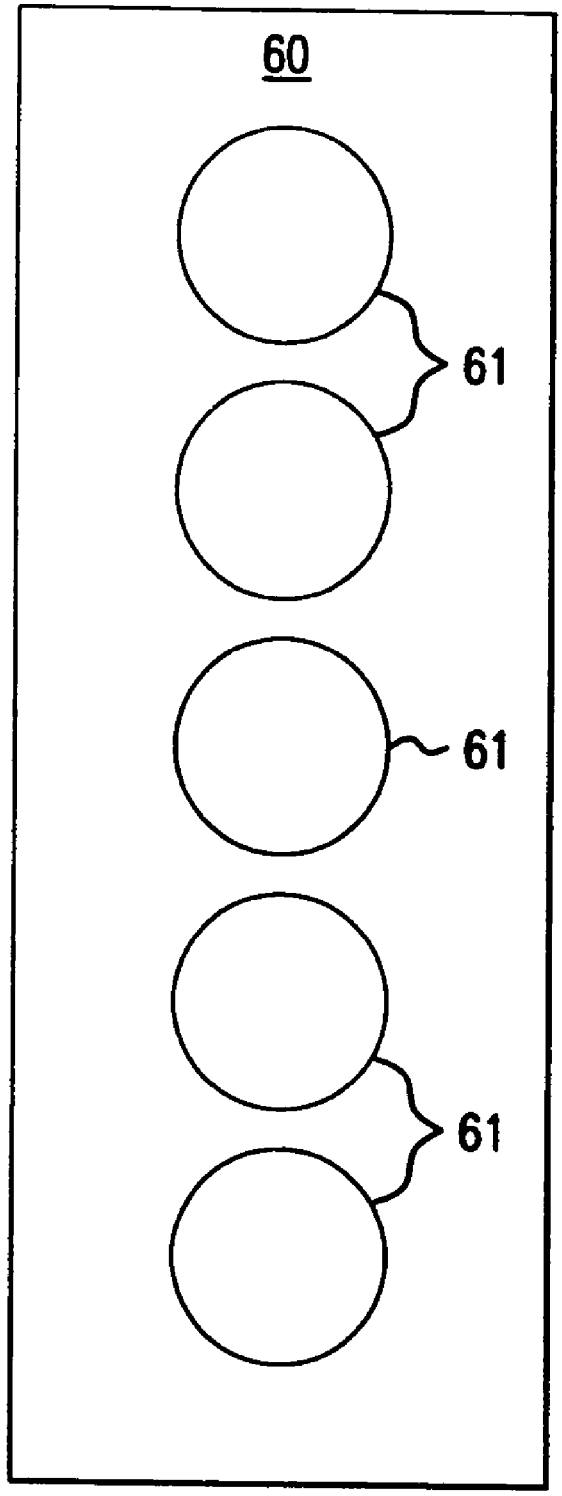
FIG. 3 is a schematic diagram of a visual annunciator of an embodiment of the present invention.

FIG. 3 is a schematic diagram of a visual annunciator 60 of an embodiment of the present invention which can give a continuous indication of the alert level. The visual annunciator has several visual indicators 61, e.g., lights or LEDs, which are preferably color-coded and correspond to the various emergency levels defined by the NOAA or other agency. The annunciator 60 may be integrated with or mounted on the fire control panel, or may stand as a separate unit apart from, but in communication with, the fire control panel. Five visual indicators are shown in FIG. 3 for illustrative purposes; however, one skilled in the art would recognize that a visual annunciator with a different number of visual indicators would fall within the scope of the present invention.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire alarm system, comprising:

a controller;

at least one hazard detector that detects any one of fire, heat, and smoke, and that communicates with the controller via a network;

at least one notification appliance in communication with the controller via the network; and a warning receiver, separate and distinct from any hazard detector, the warning receiver receiving a warning alert message from a source external to the fire alarm system, the warning receiver providing at least a part of the received warning alert message to the controller, the controller, in response to the warning alert message, causing at least one notification appliance to notify based at least in part on the received warning alert message, the notification appliance providing notification in response to detection of a change in alert status of the warning alert message.

2. The fire alarm system of claim 1, the external source being a government agency.

3. The fire alarm system of claim 2, the government agency being the U.S. National Oceanic and Atmospheric Administration (NOAA).

4. The fire alarm system of claim 3, the warning receiver being a NOAA weather radio receiver.

5. The fire alarm system of claim 3, the warning receiver comprising an interface to a NOAA weather radio receiver.

6. The fire alarm system of claim 1, the warning receiver comprising a radio receiver equipped to receive the warning alert.

7. The fire alarm system of claim 1, the warning receiver comprising an interface to a radio receiver equipped to receive the warning alert.

8. The fire alarm system of claim 7, the interface comprising at least one relay contact.

9. The fire alarm system of claim 7, the interface comprising a serial interface.

10. The fire alarm system of claim 1, the warning receiver receiving warning alerts via at least one of: Internet, telephone, and cellular phone.

11. The fire alarm system of claim 1, the fire alarm notification appliance providing notification of the received warning alert message by transmitting a voice message.

12. The fire alarm system of claim 1, the fire alarm notification appliance providing notification of the received warning alert message by transmitting a predefined audio pattern.

13. The fire alarm system of claim 1, the fire alarm notification appliance providing notification of the received warning alert message by transmitting a predefined flash pattern.

14. The fire alarm system of claim 1, the notification appliance providing different notifications for different warning alert messages.

15. The fire alarm system of claim 1, further comprising:
a delay module which provides a delay before transmission of the notification warning.

16. The fire alarm system of claim 1, further comprising:
a verification module which allows confirmation of the validity of the warning alert message before transmission of the notification.

17. The fire alarm system of claim 1, further comprising:
a battery backup system.

18. The fire alarm system of claim 1, further comprising:
a visual annunciator comprising plural visual indicators used to indicate a current alert level.

19. The fire alarm system of claim 18, the visual indicators being light emitting diodes.

20. The fire alarm system of claim 18, the visual indicators being color-coded.

21. The fire alarm system of claim 18, the visual annunciator being incorporated into a fire alarm control panel.

22. The fire alarm system of claim 18, the visual annunciator being a stand-alone device in communication with the warning receiver.

23. The fire alarm system of claim 18, the visual annunciator being incorporated into the fire alarm notification appliance.

24. The fire alarm system of claim 1, wherein the warning detector detects security/terrorist warning alerts from the external source.

25. The fire alarm system of claim 1, where the visual annunciator indicates a current threat level for Homeland Security.

26. A method, in a fire alarm system, for providing warnings, the method comprising:
receiving a warning alert from an external source;
communicating the warning alert to a central controller for the fire alarm system, the central controller also communicating with detectors and notiflcatiou appliances via a network;
in direct response to the communicating of the warning alert to the central controller, determining whether there is a change in at least a part of the warning alert and communicating from the central controller for the fire alarm system to at least one of the fire alarm notification appliance to issue an alert based at least in part on the received warning alert; and
providing, at the at least one fire alarm notification appliance, notification of the alert.

27. The method of claim 26, further comprising:
providing, from the fire alarm notification appliance, notification in response to detection of a change in alert status of the warning alert.

28. The method of claim 26, the external source being a government agency.

29. The method of claim 28, the government agency being the U.S. National Oceanic and Atmospheric Administration (NOAA).

30. The method of claim 29, the warning alert being detected by a NOAA weather radio receiver interfaced with the fire alarm system.

31. The method of claim 29, the warning alert being detected by a NOAA weather radio receiver integrated into the fire alarm system.

32. The method of claim 26, the warning alert being detected by a radio receiver equipped to receive the warning alert, the radio receiver being integrated into the fire alarm system.

33. The method of claim 26, the warning alert being detected by a radio receiver equipped to receive the warning alert, the radio receiver interfaced with the fire alarm system.

34. The method of claim 33, the method further comprising:
signaling detection of the warning alert by actuating at least one relay contact.

35. The method of claim 33, the method further comprising:
signaling detection of the warning alert via a serial interface.

36. The method of claim 26, warning alerts being received via at least one of:
Internet, telephone, and cellular phone.

37. The method of claim 26, the step of providing notification of the detected warning alert comprising:
transmitting a voice message.

38. The method of claim 26, the step of providing notification of the detected warning alert comprising:
transmitting a predefmed audio pattern.

39. The method of claim 26, the step of providing notification of the detected warning alert comprising:
transmitting a predefined flash pattern.

40. The method of claim 26, further comprising:
providing different notifications for different warning alerts.

41. The method of claim 26, further comprising:
delaying transmission of the notification warning.

42. The method of claim 26, further comprising:
providing means for confirmation of the validity of the warning alert before transmission of the notification.

43. The method of claim 26, further comprising:
indicating, in a visual annunciator with plural visual indicators, a current alert level.

44. The method of claim 43, the visual indicators being light emitting diodes.

45. The method of claim 43, the visual indicators being color-coded.

46. The method of claim 43, the visual annunciator being incorporated into a fire alarm control panel.

47. The method of claim 43, the visual annunciator being a stand-alone device in communication with the warning detector.

48. The method of claim 43, the visual annunciator being incorporated into the tire alarm notification appliance.

49. The method of claim 26, further comprising:
determining at least one recommendation based on the warning alert; and
issuing the alert based at least in part on the recommendation.

50. A fire alarm system comprising:
warning detection means for detecting a warning alert from an external source;
notification means for providing notification of the warning alert in response to detection of the warning alert; and
controller means for the fire alarm system receiving the warning alert from the warning detection means and in direct response to receiving the warning alert from the warning detection means, determining whether there is a change in at least a part of the warning alert and further communicating the warning alert to the notification means via a network.

51. The fire alarm system of claim 50, further comprising:

means for providing, from the fire alarm notification appliance, notification in response to detection of a change in alert status of the warning alert.

52. The fire alarm system, comprising:

a system controller;

a plurality of fire alarm notification appliances in communication with the system controller;

a warning receiver in communication with the system controller, the warning receiver detecting a warning alert from an external source; and a visual annunciator comprising plural color-coded indicators, the visual annunciator being in communication with the warning receiver via the system controller, the system controller receiving the warning alert from the warning receiver and, in response, sending a command to the visual annunciator to indicate a current alert level in the received warning alert.

53. The fire alarm system of claim 52, the color-coded indicators being light emitting diodes.

54. The fire alarm system of claim 52, the visual annunciator being incorporated into any of: the system controller; and at least one of the fire alarm notification appliances.

55. The fire alarm system of claim 52, the visual annunciator being a stand-alone device in communication with the warning receiver.

56. The fire alarm system of claim 52, where the visual annunciator indicates a current alert level after a detected change in alert status.

57. A fire alarm system comprising:

a fire alarm system controller;

a fire alarm notification appliance in communication with the system controller;

a warning detector which detects a security/terrorist warning alert from a source external to the fire system, the fire alarm notification appliance communicating with the system controller, wherein the system controller detects a change in at least a part of the warning alert and the system controller provides notification of the warning alert in direct response to the detected change in at least a part of the warning alert.

* * * * *

UNITED STATES PATENT AND TRADEMARK OFFICE

CERTIFICATE OF CORRECTION

PATENT NO. : 7,295,127 B2
APPLICATION NO. : 10/720810
DATED : November 13, 2007
INVENTOR(S) : John R. Haynes It is certified that error appears in the above-identified patent and that said Letters Patent is hereby corrected as shown below:

In the Specification

In column 3, line 63, after "of a visual annunciator" delete "60" and substitute --61-- in its place.

In column 3, line 66, after "visual indicators" delete "60".

In column 4, line 3, after "The annunciator" delete "60" and substitute --61-- in its place.

In the Claims

Column 5, in claim 26, line 6, after "with detectors and", delete "notiflcatiou" and substitute --notification-- in its place.

Column 6, in claim 38, line 3, after "transmitting a" delete "predefmed" and substitute --predefined-- in its place.

Column 6, in claim 48, line 2, after "incorporated into the" delete "tire" and substitute --fire-- in its place.

Signed and Sealed this

Twenty-ninth Day of April, 2008

JON W. DUDAS
*Director of the United States Patent and Trademark Office*